US008303767B2

(12) United States Patent
Francis

(10) Patent No.: US 8,303,767 B2
(45) Date of Patent: Nov. 6, 2012

(54) METHODS OF PRETREATING COMMINUTED CELLULOSIC MATERIAL WITH CARBONATE-CONTAINING SOLUTIONS

(75) Inventor: Raymond Francis, Syracuse, NY (US)

(73) Assignee: The Research Foundation of State University of New York, Albany, NY (US)

( * ) Notice: Subject to any disclaimer, the term of this patent is extended or adjusted under 35 U.S.C. 154(b) by 0 days.

(21) Appl. No.: 12/933,185

(22) PCT Filed: Mar. 17, 2009

(86) PCT No.: PCT/US2009/037380

§ 371 (c)(1),
(2), (4) Date: Nov. 29, 2010

(87) PCT Pub. No.: WO2009/117402

PCT Pub. Date: Sep. 24, 2009

(65) Prior Publication Data

US 2011/0094692 A1 Apr. 28, 2011

Related U.S. Application Data

(60) Provisional application No. 61/037,530, filed on Mar. 18, 2008.

(51) Int. Cl.
*D21C 3/26* (2006.01)

(52) U.S. Cl. ..... 162/17; 162/29

(58) Field of Classification Search ..... 162/17, 162/29, 65, 82

See application file for complete search history.

(56) References Cited

U.S. PATENT DOCUMENTS

| | | | |
|---|---|---|---|
| 1,887,241 | A | 11/1932 | Hooper et al. |
| 3,759,783 | A | 9/1973 | Samuelson et al. |
| 4,135,967 | A | 1/1979 | Fogarassy |
| 4,222,819 | A | 9/1980 | Fossum et al. |
| 4,436,586 | A | 3/1984 | Elmore |
| 4,466,861 | A | 8/1984 | Hultman et al. |
| 4,537,656 | A | 8/1985 | Lindahl et al. |
| 4,612,286 | A | 9/1986 | Sherman et al. |
| 4,652,341 | A | 3/1987 | Prior |
| 4,668,340 | A | 5/1987 | Sherman |
| 4,670,098 | A | 6/1987 | Thorsell et al. |
| 4,725,335 | A | 2/1988 | Samuelson |
| 4,851,082 | A | 7/1989 | Mita et al. |
| 4,921,613 | A | 5/1990 | Nordberg et al. |
| 5,306,392 | A | 4/1994 | Mita |
| 5,338,366 | A | 8/1994 | Grace et al. |
| 5,454,907 | A | 10/1995 | Hayashi |
| 5,489,363 | A | 2/1996 | Marcoccia et al. |
| 5,522,958 | A | 6/1996 | Li |
| 5,536,366 | A | 7/1996 | Marcoccia et al. |
| 5,547,012 | A | 8/1996 | Marcoccia et al. |
| 5,589,033 | A | 12/1996 | Tikka et al. |
| 5,620,562 | A | 4/1997 | Marcoccia et al. |
| 5,662,775 | A | 9/1997 | Marcoccia et al. |
| 5,824,188 | A | 10/1998 | Prough et al. |
| 5,849,150 | A | 12/1998 | Marcoccia et al. |
| 5,849,151 | A | 12/1998 | Marcoccia et al. |
| 6,086,712 | A | 7/2000 | Marcoccia et al. |
| 6,132,556 | A | 10/2000 | Stromberg et al. |
| 6,159,337 | A | 12/2000 | Marcoccia et al. |
| 6,248,209 | B1 | 6/2001 | Maeda et al. |
| 6,280,567 | B1 | 8/2001 | Gustavsson et al. |
| 6,280,568 | B1 | 8/2001 | Marcoccia et al. |
| 6,346,167 | B2 | 2/2002 | Marcoccia et al. |
| 6,569,289 | B2 | 5/2003 | Stromberg et al. |
| 6,861,023 | B2 | 3/2005 | Sealey, II et al. |
| 7,077,931 | B2 | 7/2006 | Snekkenes et al. |
| 7,090,744 | B2 | 8/2006 | Sealey, II et al. |
| 2006/0225852 | A1 | 10/2006 | Pekarovic et al. |
| 2007/0167618 | A1 | 7/2007 | Wang et al. |
| 2007/0284068 | A1 * | 12/2007 | Francis et al. ..... 162/17 |

FOREIGN PATENT DOCUMENTS

| | | | |
|---|---|---|---|
| AU | 505746 | | 11/1979 |
| CA | 1096560 | A | 3/1981 |
| JP | 1999-286883 | | 10/1999 |
| WO | 00/47812 | A | 8/2000 |
| WO | 2004/067572 | A1 | 8/2004 |
| WO | 2006/121634 | A2 | 11/2006 |
| WO | 2007137127 | A | 11/2007 |

OTHER PUBLICATIONS

International Search Report and Written Opinion for corresponding PCT application No. PCT/US2009/037380, mailed Sep. 8, 2009.
International Preliminary Report on Patentability for corresponding PCT application No. PCT/US2009/037380, mailed Sep. 30, 2010.
Gellerstedt et al. "The Influence on Bleachability of Changes in Pulping Chemistry." Fifth European Workshop on Lignocellulosics and Pulp, pp. 547-550, 1998.

(Continued)

*Primary Examiner* — Mark Halpern
(74) *Attorney, Agent, or Firm* — Heslin Rothenberg Farley & Mesiti P.C.

(57) ABSTRACT

Methods of pretreating comminuted cellulosic material with an acidic solution and then a carbonate-containing solution to produce a pretreated cellulosic material are provided. The pretreated material may then be further treated in a pulping process, for example, a soda-anthraquinone pulping process, to produce a cellulose pulp. The pretreatment solutions may be extracted from the pretreated cellulose material and selectively re-used, for example, with acid or alkali addition, for the pretreatment solutions. The resulting cellulose pulp is characterized by having reduced lignin content and increased yield compared to prior art treatment processes.

20 Claims, 2 Drawing Sheets

OTHER PUBLICATIONS

Lundqvist et al. "Improved Process Efficiency by Pre-Treatment of Chips." Eight International Conference on New Available Technologies, Stockholm Sweden, Jun. 14-16, 2005.
Rutkowski et al. "Preparation of Deeply Delignified Pulps by Birchwood Pulping with Acetic Acid." Institute of Papermaking and Paper Machines, Technical University of Lodz, 1996.
Bolton et al. "Chemical and Physical Changes Due to Acidolysis of Chips Ahead of Alkaline Pulping." Proceedings of the 14th International Symposium of Wood, Pulp, Fiber Chemistry, Durban, South Africa, 2007.
Bolton et al. "A Biorefinery Approach: Non-Sulfur Pulping with Partial Lignin Recovery and Conversion." Tappi Journal, Bonus Issue, Mar. 2008, pp. 44-57, 2007.
Bolton et al. "Mild Acid Pre-Treatment Ahead of SAQ Pulping or Birch Chips", ESPRA, Syracuse, NY, Oct. 11, 2007.
Mishra and Liu. "Kraft Pulping Kinetics of Hot-Water Extracted Eucalyptus Wood Chips Part I: An Experimental Study." ESPRI Research Report #127, Oct. 2007.
International Search Report and Written Opinion for PCT application PCT/2007/069159 dated Mar. 10, 2009.

* cited by examiner

METHODS OF PRETREATING COMMINUTED CELLULOSIC MATERIAL WITH CARBONATE-CONTAINING SOLUTIONS

CROSS-REFERENCE TO RELATED APPLICATIONS

This application is a §371 national stage filing of PCT International Application No. PCT/US2009/037380 filed on Mar. 17, 2009 and published in English on Sep. 24, 2009, as WO 2009/117402 A2, which claims priority from This U.S. Provisional Patent Application 61/037,530 filed on Mar. 18, 2008. The entire disclosures of these applications are incorporated herein by reference in their entirety.

STATE AND FEDERAL FUNDED RESEARCH

This invention was made with government support under DE-FG02-06ER64266 awarded by the Department of Energy. The government has certain rights in the invention.

BACKGROUND

1. Field of the Invention

The present invention relates to the treatment of comminuted cellulosic material, for example, wood chips, to enhance the properties of the pulp produced from the cellulosic material. More particularly, the present invention relates to the pretreatment of cellulosic material with acidic solutions and carbonate solutions prior to treatment with pulping chemicals.

2. Description of Related Art

Prehydrolysis of wood chips initiated with hot water or dilute acetic acid is an established practice in the pulp and paper industry. For example, U.S. Pat. No. 4,436,586 of Elmore; U.S. Pat. No. 4,668,340 of Sherman; U.S. Pat. No. 4,612,286 of Sherman, et al.; and U.S. Pat. No. 5,589,033 of Tikka, among others, disclose processes for acid hydrolysis pretreatment of wood chips. U.S. Pat. No. 4,652,341 of Prior discloses a process of nitric acid pretreatment of wood chips, and then caustic extraction. However, there is renewed interest in this treatment because the sugars dissolved the acidic solution, that is, the hydrolyzates, can be a source of lignocellulosic ethanol.

Approximately 70% of the hemicelluloses dissolve in the cooking liquor during kraft or soda/anthraquinone (SAQ) pulping. These dissolved hemicelluloses consume a significant fraction of the active cooking chemical, that is, the alkali, in the process of being degraded to low molecular weight compounds. With the present state of pulping technology, it would be technically difficult to remove these low molecular weight compounds from alkaline pulping effluents and purify these compounds into product streams to a degree adequate enough for use as commodity chemicals. The low molecular weight products that are generated from hemicellulose degradation during alkaline pulping have a high oxygen to carbon ratio and relatively low calorific values during combustion.

One team of researchers, Bolton, et al. "Chemical and physical changes due to acidolysis of chips ahead of alkaline pulping." Proceedings of the 14$^{th}$ International Symposium of Wood, Pulp, Fiber Chemistry, Durban, South Africa, Jun. 25$^{th}$-28$^{th}$ (herein "Bolton (2007A)," included by reference herein in its entirety), including the present inventor, found that an acid treatment of chips followed by a soda/anthraquinone (SAQ) pulping process provides an improved pulp yield for hardwood chips compared to kraft treatment alone.

From this and other research, the present inventor surmises that reducing end groups (REGs) may be generated when glycosidic bonds are cleaved in an acid (or A-stage) treatment of wood chips. For example, typically when the free A-stage effluent is drained off after acid treatment, the chips retain about 1.0 liters of solution per kilogram of chips (on an oven-dried basis). Typically, this entrained liquid is transferred with the chips to the subsequent alkaline carbonate neutralization stage, if provided, or transferred directly to the chemical pulping stage, for example, to a kraft or a SAQ pulping stage. The inventor further surmises that the reducing end groups in the acid liquor that is transferred to the subsequent treatment both accelerate the rate of SAQ delignification and improves pulp yield. As is known in the art, pulp "yield" of a pulping process is the percent by weight of the delignified pulp fibers (about 90% lignin removal from wood) compared to the weight of the wood chips introduced to the process. A higher pulp yield is preferred.

Specifically, the inventor surmises that the higher concentration of reducing end groups (REG) can reduce anthraquinone (AQ) in the SAQ process at a higher rate to form anthrahydroquinone (AHQ), that is, the active delignification catalyst in the SAQ process. The AQ/AHQ catalytic cycle is shown schematically in FIG. 1. In addition, when a reducing end group in the solid phase is oxidized by AQ to a carboxylic acid it becomes resistant to the alkaline peeling reaction that lowers the molecular weight of carbohydrates resulting in solubilzation and a decrease in pulp yield. The hypothesis above may explain why the A-stage improves pulp yield for SAQ pulping, but not for kraft pulping. For example, the oxidation of reducing end groups to carboxylic acids is not known to be a significant reaction (or even occur) in the kraft process.

However, the present inventor has found it difficult to verify this hypothesis. This difficulty is due to the lack of analytical approaches to test this hypothesis on the significance of carryover of reducing end groups (REG). In Bolton (2007A), the investigators reported that mild acidolysis increased the content of reducing end groups in sugar maple from 0.33 mmole/g to 0.38 mmole/g. In that investigation, the test method was the reduction of dinitrosalicylic acid (DNS) with the reaction products being quantified by visible spectroscopy. The researchers also reported on the effect of purchased birch xylan added directly to SAQ cooking. It is believed that the xylan hydrolyzes during the alkaline pulping stage and generates additional REG. A lower kappa number (that is, an indication of the presence of undesirable lignin in the cellulose pulp, where wt. % of lignin≈0.15×kappa number) was obtained as well as less rejects. However, additional research by Bolton, et al. 2007. "A biorefinery approach: Nonsulfur pulping with partial lignin recovery and conversion." 2007 TAPPI Environ. Pulping and Engineering Conference, Jacksonville, Fla. (herein "Bolton (2007B)," included by reference herein in its entirety), including the present inventor, included no mention of any quantification of REG because of suspicion that the DNS method is unreliable when the sample (wood meal or effluent) is highly colored.

Another team of researchers, Bolton, et al. ("Mild Acid Pre-Treatment Ahead of SAQ Pulping of Birch Chips," ESPRA, Syracuse, N.Y., Oct. 11, 2007 (herein "Bolton (2007C)," included by reference herein in its entirety), including the present inventor, reported on the mild acidolysis of sugar maple and birch chips ahead of SAQ pulping. Bolton (2007C) found that acid pretreatment and sodium carbonate neutralization followed by chemical pulping produced a more selective pulp, that is, a pulp having less undesirable lignin and more cellulose, than wood chips cooked without the acid and carbonate pretreatments.

According to the prior art, for example, as exemplified by the above patents of Elmore, Tikka, Sherman, and Prior, the hydroxide anion ($OH^-$) to is used to neutralize acid pretreated biomass, for example, wood chips. In contrast to this and related prior art, aspects of the present invention employ the carbonate anion ($CO_3^{2-}$) for neutralization, which the present inventor shows provides superior pulp properties compared to pulp produced with hydroxide neutralization.

According to aspects of the present invention, the inventor has found that re-using the effluents from one or more of the acid pre treatment and the carbonate pretreatment provides further enhancements on the quality of the pulp produced by chemical pulping processes.

BRIEF SUMMARY OF ASPECTS OF THE INVENTION

The present invention improves on the above prior art and others, by recognizing that an improved pulp can be produced by pre-treating the chips with an acid solution and a carbonate solution and recirculating or reusing at least some of the treatment effluents to supplement and/or replace at least some of the acid and/or carbonate treatment solutions.

One aspect of the invention is a method of treating comminuted cellulosic material including treating the comminuted cellulosic material in a first stage with a first acidic solution to produce an acid treated material and a second acidic solution; extracting the second acidic solution from the acid treated material and using at least some of the second acidic solution for at least some of the first acidic solution; treating the acid treated material with a first carbonate-containing solution to produce a carbonate treated material and a second carbonate-containing solution; extracting the second carbonate-containing solution from the carbonate treated material and using at least some of the second carbonate-containing solution for at least some of the first carbonate-containing solution; and treating the carbonate treated material with pulping chemical to produce a cellulose pulp. In one aspect, the first carbonate-containing solution comprises substantially little or no hydroxide ions. In another aspect, the first carbonate-containing solution comprises an $OH^-$ concentration less than the $OH^-$ concentration of a solution having a sodium hydroxide (NaOH) concentration of about 1 gram per liter or less of NaOH. In another aspect, the method produces a cellulose pulp having greater yield than the pulp produced when practicing the method without treating the acid treated material with the first carbonate-containing solution.

These and other aspects, features, and advantages of this invention will become apparent from the following detailed description of the various aspects of the invention taken in conjunction with the accompanying drawings.

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

DETAILED DESCRIPTION OF ASPECTS OF THE INVENTION

Based upon the prior investigations discussed above, the present inventor surmised that since the A-stage, (or acid treatment stage) and N-stage (or neutralization stage) disclosed on the above investigations could be relatively "mild," that is, resulting in relatively milder treatment of the wood chips and less dissolved organic material in the treatment effluents, trials were then performed in which at least some of the A-stage effluents and at least some of the N-stage effluents were re-used to replace or supplement the A-stage and/or N-stage treatment solutions. Surprisingly, it was found that this recirculation of at least some of the treatment effluents produced a pulp having improved properties, that is, higher yield and lower lignin content after subsequent pulping, in particular, after subsequent SAQ pulping.

Figure 1:
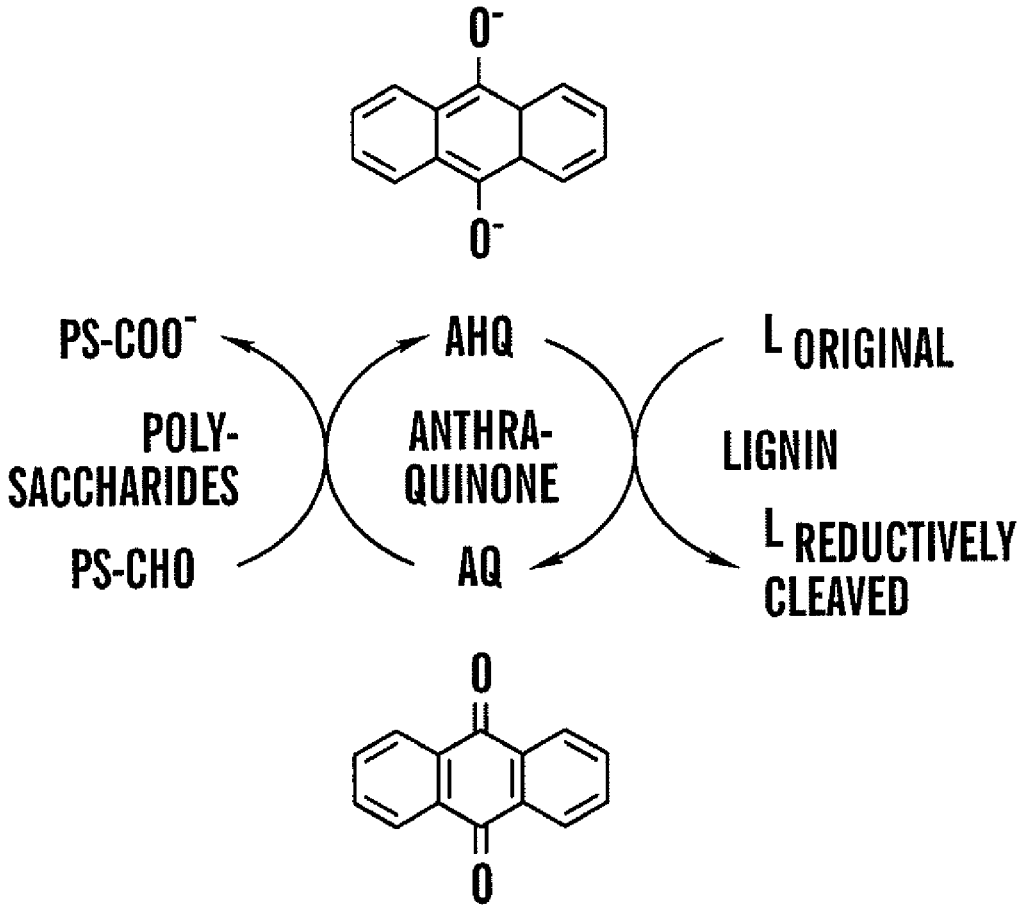
FIG. 1 is a schematic illustration of the oxidation-reduction cycle for anthraquinone (AQ) and anthrahydroquinone (AHQ).
Figure 2:
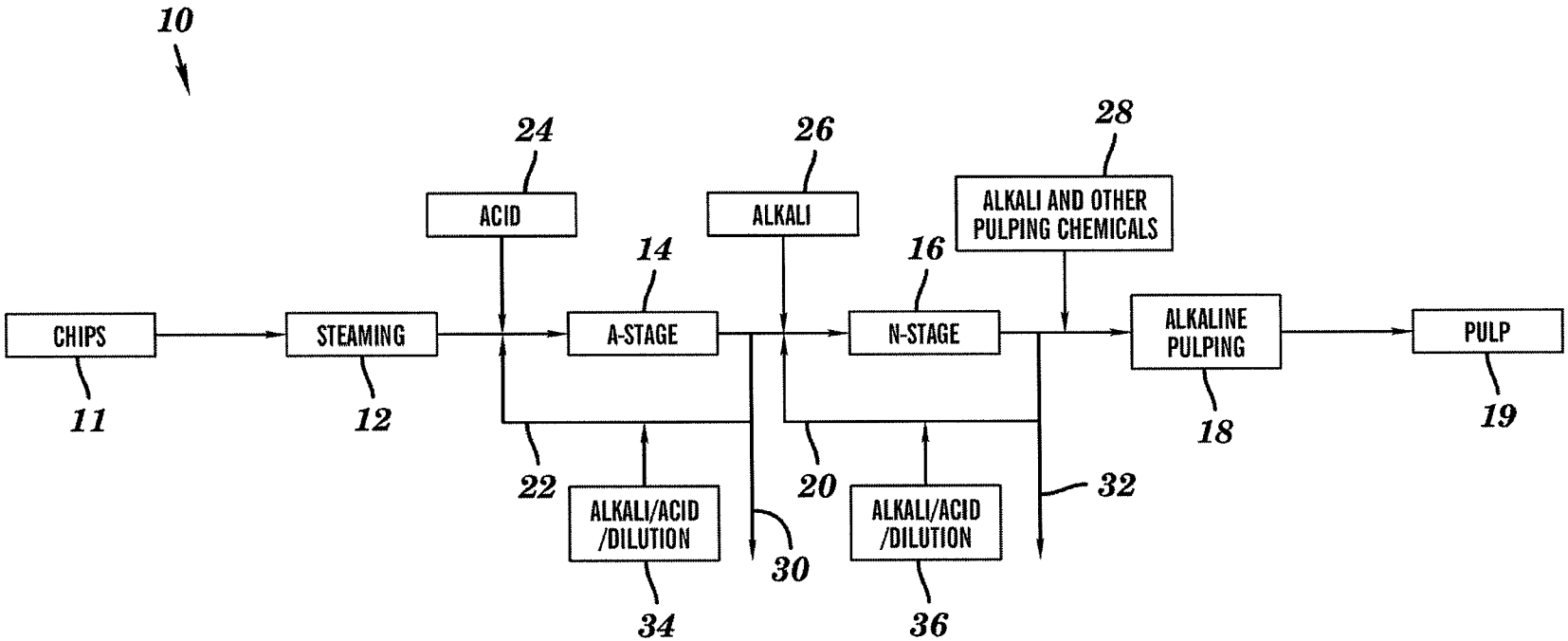
FIG. 2 is a schematic illustration of a system employing a method of treating comminuted cellulosic material according to one aspect of the invention.

A flow chart for an aspect of the invention in which comminuted fibrous material, for example, wood chips, are pretreated in an acid stage followed by a neutralization stage with at least some recycle or re-use of the treatment liquids is shown in FIG. 2. The results of laboratory trials performed in laboratory batch treatment vessels according to aspects of the invention are summarized in Tables 1 and 2.

TABLE 1

The Acid-Neutralization Pretreatment Ahead of Alkaline Pulping of Sugar Maple with 100% Recycle of A-stage Effluent

| Run No. | A-Stage pH[1] | % Recycle of N-Stage Effluent | $Na_2O$ in SAQ | Screened[2] Yield, % | Kappa No. |
|---|---|---|---|---|---|
| 1 | ~6.0→4.8[3] | 0 | 12% | 51.7 (0.1) | 16.1 (9.4)[4] |
| 2 | 4.8→4.7 | 0 | 12% | 51.9 (0.1) | 16.1 |
| 3 | 4.7→4.7 | 0 | 12% | 52.3 (0.1) | 16.7 (9.3) |
| 4 | 4.7→4.6 | 0 | 11% | — | 18.0 |
| 5 | 5.4→4.9[5] | 75 | 11% | 53.0 (0.2) | 18.3 |
| 6 | 4.9→4.7 | 100 | 11% | 53.4 (0.3) | 17.5 (10.9) |
| 7 | 3.7→3.8[6] | 100 | 11% | 53.2 (0.1) | 17.7 (10.9) |

[1]Stage performed with 100% liquor recycle from prior run (except for Run #1)
[2]Percent on chips; % rejects in parentheses
[3]Initial and end pH; Run numbers 1-6 were conducted 60 minutes at 120° C.
[4]Kappa number after oxygen ($O_2$) delignification in parentheses
[5]Sodium carbonate (0.08% $Na_2O$ on chips) added to effluent from prior run
[6]Acetic acid (2.0% on chips) added to effluent from Run 6; 30 min to 130° C. and 15 min at The results tabulated in Table 1 reveal that 100% recycle of both A-stage and the N-stage effluents increased the pulp yield after pulping from 51.7% to 53.2% on hardwood chips, in particular sugar maple chips. That is, a comparison of the screened yield of Run 1 in Table 1 with fresh water used in the A-stage and N-stage with the data of Run 7 with 100% recycle of effluents from the previous run indicates a 1.5% increase in screened yield. When full recycle of both A-stage and the N-stage effluent is practiced, the only discharge point for soluble carbohydrate oligomers from the A-stage is the entrance to the pulping stage, for example, an SAQ stage. According to one aspect of the invention, only about 1.0 liters of N-stage effluent per kg of chips is transferred from the N-stage to the subsequent pulping stage, for example, kraft pulping or an SAQ pulping. Typical previous trials were operated by transferring essentially all of the N-stage effluent (for example, about 4 L/kg) from the N-stage to the subsequent pulping stage, for example, to the SAQ stage. However, the disadvantage of transferring N-stage effluent to the subsequent pulping stage is that the sodium bicarbonate [$NaHCO_3$] contained in the N-stage effluent may consume NaOH to form the $Na_2CO_3$, which is believe to be inert in the SAQ stage, for example, by the following equation 1.

$$NaHCO_3+NaOH \rightarrow Na_2CO_3+H_2O \quad [1]$$

It will be understood by those of skill in the art that though the term comminuted fibrous material or "wood chips" is used to facilitate discussion of the invention, aspects of the invention are not limited to treating chips, but may be used to treat any form of comminuted cellulosic fibrous material, including, but not limited to, hardwood chips, softwood chips, sawdust, recycled fibers, recycled paper, agricultural waste, such as bagasse, and other fibrous cellulosic material. The data in Table 2 reflect the results of treating softwood chips, in particular softwood loblolly pine chips according to aspects of the invention.

TABLE 2

The Acid-Neutralization Pretreatment Ahead of Alkaline Pulping of Loblolly Pine with 100% Recycle of A-stage Effluent. $Na_5DTPA$ added to the N-stage and 20% of N-stage Effluent was Discharged.

| Run No. | A-Stage pH[1] | H-Factor in SAQ Stage | $Na_2O$ in SAQ | Total[2] Yield, % | Kappa No. | Delta Kappa (%) |
|---|---|---|---|---|---|---|
| 1 | 3.8→3.5[3] | 1934 (170° C.) | 13% | 48.8 | 42.1 (21.4)[4] | 49.1 |
| 2 | 3.5→3.9 | 2486 (175° C.) | 14% | 46.7 | 36.8 (16.9) | 54.0 |
| 3 | 3.9→3.7 | 2486 (175° C.) | 14% | 46.8 | 38.2 (16.0) | 58.1 |
| 4 | 3.7→3.6 | 2486 (175° C.) | 14% | 47.3 | 37.9 (15.8) | 58.3 |

[1]Stage performed with 100% liquor recycle from prior run (except for Run #1)
[2]Percent on chips; rejects <0.2% on all occasions
[3]Initial and end pH; all 4 runs were conducted 30 min at 120° C.
[4]Kappa number after $O_2$ delignification in parentheses Softwoods are generally much less responsive to SAQ pulping compared to hardwoods, such as, birch and sugar maple. Laboratory trials similar to those discussed above were made employing aspects of the invention on loblolly pine chips. In these trials, the results of which are shown in Table 2, the first A-stage was performed for 30 minutes at 120° C. with a 2.0% acetic acid on chips solution with acid effluent recycle. The end pH of the acid treatment was kept below 4.0 in subsequent A-stage effluents by the addition of a small amount of acetic acid to the liquor being recycled. After the first run, 20% of the free N-stage effluent was discarded and 0.1% $Na_5DTPA$ (sodium diethylenetriaminepentaacetate) on chips, a chelating agent, was added to the fraction being recycled. This volume of discharged liquid, in this case only about 0.6 Liters/kg of chips, served as a purge for transition metals, which are known to interfere with oxidative bleaching treatments. Unlike the results for sugar maple shown in Table 1, the data in Table 2 reveal that the percent delignification produced by oxygen ($O_2$) delignification treatment (kappa number after $O_2$ delignification appears in parentheses in Table 2) increased as the number of liquid recycles increased. Oxygen delignification appears to lower the kappa number by 49% after the initial treatment by Acid-Neutralization then SAQ pulping (that is, [42.1−21.4]/42.1=49%). This decrease in kappa number increased to 54% after the first recycle with $Na_5DTPA$ chelant was added to the N-stage, and oxygen delignification lowered the kappa number by 58% after the second and third recycles.

As is known in the art, chemical pulps may typically be bleached or delignified to remove as much residual lignin from the pulp in order to produce the whitest or brightest sheet of paper. The bleaching sequence that is typically employed in laboratory testing, and which can be employed according to aspects of the invention, is $OD_0EpD_1$ sequence. In this bleach sequence, O represents alkaline oxygen treatment; $D_0$ is chlorine dioxide delignification with an end pH of 2-3; Ep is alkaline extraction with sodium hydroxide and hydrogen peroxide for incremental delignification; and $D_1$ is a chlorine dioxide brightening treatment with an end pH of 3.4-4.5. A higher rate of delignification in the O stage normally results in a higher final brightness after bleaching (i.e., an improved bleachability). Aspects of the present invention provided an improved bleachability.

According to one aspect of the invention, the inventor surmises that the soluble carbohydrate oligomers entering the SAQ stage are beneficial to the SAQ stage, depending on the history and concentration of the carbohydrate oligomers. However, since the inventor knows of no credible analytical method to adequately characterize these oligomers and to quantify the concentration of the probable active functional groups, that is, the reducing end groups (REG), the above hypothesis may be incorrect. However, the accuracy of this hypothesis in no way limits, invalidates, or detracts in any way from the effectiveness of aspects of the present invention. According to aspects the present invention, at least some re-use or recycle of treatment solution from at least one of an A-stage or an N-stage can favorably affect the overall process chemistry of the cellulose treatment, for example, provide a more selective treatment, that is, lower lignin content and higher yield.

In one aspect, a high re-use or recycle rate of both the A-stage and N-stage treatment solutions, for example, substantially 90 to 100% of the treatment solution can favorably affect the cellulose material treatment. In one aspect of the invention, at least some of the A-stage treatment solution and/or at lest some of the N-stage treatment solution can be reused or recycled to positively affect the cellulose material treatment. In another aspect of the invention, at least 25% of the A-stage treatment solution and/or at least 25% of the N-stage treatment solution can be reused or recycled to positively affect the cellulose material treatment. In another aspect of the invention, at least 50% of the A-stage treatment solution and/or at least 25% of the N-stage treatment solution can be reused or recycled to positively affect the cellulose material treatment. In one aspect, at least one of a milder A-stage and a milder N-stage combined with a kraft or SAQ can have a positive effect upon the cellulose material treatment, for example, lower lignin content and higher yield than prior art methods.

According to aspects of the invention, the A-stage and/or N-stage may be located ahead of any alkaline pulping process including a kraft, a modified kraft, a soda, a SAQ, or a polysulfide treatment. In one aspect, for example, when aspects of the invention are followed by a kraft pulping treatment, kraft green liquor (that is, aqueous $Na_2S+Na_2CO_3$) recovered from a recovery boiler, furnace, or gasifier may be the source of alkali in the N-stage. In one aspect, water vapor and $NaHS/Na_2S$ may be evaporated from the green liquor and recovered, for example, by condensation. The un-evaporated green liquor fraction may be treated to recover sodium carbonate, for example, the green liquor may be cooled to promote crystallization of sodium carbonate. These substantially sulfur-free (as discussed below) sodium carbonate crystals may then be isolated, for example, by filtration, and used as the source of carbonate in the N stage, for example, after dissolution in an appropriate liquid.

FIG. 2 is a schematic illustration of a system 10 employing a method of treating comminuted cellulosic material according to one aspect of the invention. According to the conventional art, wood chips 11 are first steamed 12 to remove air from the chips and to begin the heating of the chips. According to the invention, the steamed chips are treated in an acid (A) stage 14, and then the acid-treated chips are treated in a neutralizing (N) stage 16 with an alkaline liquid, such as, sodium carbonate. After this pretreatment, the pretreated chips are forwarded to a pulping stage 18, for example, a soda, soda-AQ, or a kraft cooking stage to produce cellulose pulp 19, which may be forwarded to further treatment, for example, to washing and/or bleaching. The pulping stage 18 may be practiced with little or no sulfur; for example, the pulping stage 18 may be "sulfur free," for instance, a sulfur free NaOH treatment or sulfur free SAQ treatment.

According to the present invention, after treating the chips in the A stage 14 and/or the N-stage 16, a least some of the treatment liquid or solution, that is, the treatment "effluent," may be removed from the chips after treatment in the A stage, or optionally from the chips after the A and N stages, and recirculated as indicated by 20 and 22 in FIG. 2 and introduced to the chips prior to or during the A-stage 14 or N-stage 16. In one aspect, at least some of the products of the A-stage treatment 14 and/or N-stage treatment 16 may be present in the recirculated streams 20 and 22, respectively, for example, whereby at least some of the products of the A-stage treatment or the N-stage treatment may be present at the beginning of or during the A-stage or N stage.

In one aspect of the invention, the treatment solution or liquid 24 introduced to the A-stage includes at least some acid, for example, an organic acid (such as, acetic acid) or an inorganic acid (such as, nitric, sulfuric acid, or hydrofluoric acid). In one aspect, the acid treatment solution 24 is substantially devoid of any sulfur compounds, for example, it is substantially "sulfur free." In one aspect, stage 14 may be practiced in the presence of a naturally occurring acid, that is, a naturally occurring wood acid. The acid treatment liquid 24 may be provided to produce an aqueous environment about chips 11 having a pH of about 6 or below, for example, having a pH of between about 1 and about 6. The acid treatment may be practiced at a temperature greater than 50 degrees C., for example, at about 80 degrees C. to about 160 degrees C. The acid treatment may be relatively mild, whereby the content of the dissolved wood solids in the treatment liquor is kept relatively low, for example, typically less than about 10 grams/liter. For example, the acid stage 14 may be practice at a temperature less than 200 degrees C., or less than 160 degrees C., or less than 120 degrees C. Acid treatment stage 14 may typically practiced for a sufficient time to provide at least some benefit to the resulting pulp produced in process 10. For example, acid treatment stage 14 may be practiced for at least 5 minutes, but may be practiced from about 30 minutes to about 6 hours, and is typically practiced from about 30 minutes to about 60 minutes, depending upon the nature of the furnish, for example, the pH of chips 11. The quantity of acid used in treatment stage 24 may include any amount needed to produce the same effect as about 1% to about 6% acetic acid on chips at about 120° C.

According to aspects of the invention, the neutralization or "N-stage" treatment stage 16 may be practiced with an alkaline treatment liquid or solution 26 to, among other things, neutralize the acidic liquid remaining with the chips 11 after acid stage 14. Alkaline treatment solution 26 may have a pH ranging from 7 to 14, but is typically, less than pH 12.3, for example, less than pH 11.8, or even less than pH 10. In one aspect of the invention, in contrast to certain prior art treatments, treatment solution 26 may contain little or no hydroxide ions [$OH^-$]. In another aspect, also in contrast to certain prior art treatments, the treatment solution 26 may have an $OH^-$ concentration less than the $OH^-$ concentration obtained from a 1 gram per liter solution of NaOH, for example, solution 26 may have an $OH^-$ concentration less than the $OH^-$ concentration obtained from a 0.5 grams per liter solution of NaOH. While, in one aspect of the invention, a carbonate-based N-stage may provide at least some additional activation to the subsequent pulping stage, a NaOH-based N-stage may not provide additional activation and, typically, does not. In one aspect of the invention, a carbonate-based N-stage may provide significant additional activation to the subsequent pulping stage, for example, where a more selective treatment is effected in the subsequent pulping stage, that is, a treatment that typically is not provided by a NaOH-based pretreatment. In one aspect, the treatment solution 26 may contain little or no sulfur.

According to one aspect of the invention, treatment solution 26 may include at least some carbonate, for example, at least some sodium carbonate [$NaCO_3$], or at least some potassium carbonate [$K_2CO_3$], or at least some magnesium carbonate [$MgCO_3$], or combinations or mixtures thereof. The treatment solution 26 having at least some carbonate, that is, the carbonate-containing solution, may have a pH less than or equal to 12.3, for example, a pH less than or equal to 11.8, or even less than or equal to 10. The carbonate-containing solution may also have a pH greater than 7. When neutralization stage 14 is practiced with a sodium carbonate solution, the carbonate-containing solution may be a sulfur-free carbonate solution. Again, in one aspect of the invention, carbonate treatment liquid 26 may contain little or no hydroxide ions and/or may have an $OH^-$ concentration less than the $OH^-$ concentration obtained from a solution having a concentration of about 1 gram per liter or less of NaOH, for example, an $OH^-$ concentration less than the $OH^-$ concentration obtained from a solution having a concentration of about 0.5 grams per liter or less of NaOH. The carbonate-containing solution may be obtained from spent pulping chemical from the pulping stage 18, for example, from green liquor from a kraft recovery system, or green liquor from which the $Na_2S$ has been separated or minimized.

As shown in FIG. 2, according to one aspect of the invention, at least some of the effluent from A-stage 14 and/or N-stage 16 may be removed from system 10, for example, by means of purge streams 30 and/or 32. Purge streams 30 and 32 may be used to regulate the content or volume of the effluent recycled or to remove undesirable constituents from the system 10. For example stream 30 or 32 may be used as a means to regulate the concentration of dissolved metal compounds, to regulate the concentration of dissolved organic material, or to regulate the volume of the liquid recirculated. The liquid in purge streams 30 and 32 may be reintroduced in other areas of system 10, processed or otherwise treated for chemical recovery or re-use, or simply sewered.

As also shown in FIG. 2, the liquid in recirculation conduits 20 and 22 may also be augmented by adding an acid, an alkali, or dilution sources 34 and/or 36. For example, liquid may be introduced to conduits 20 and/or 22 to replace the liquid removed via conduits 30 and/or 32. In addition, an acid or an alkali may be introduced to conduits 20 and/or 22 to regulate the pH, chemical concentration, and/or liquid content (that is, the liquid-to-wood ratio) of the treatment solutions in A-stage 14 and/or N-stage 16. For example, one or more of the acids referenced above may be introduced to conduit 20 to regulate the pH in A-stage 14. One or more alkalis may be introduced to conduit 22 to regulate the pH and/or chemical concentration in N-stage 16. For example, a carbonate-containing solution may be used to regulate the carbonate concentration in N-stage 16. In one aspect, the liquids introduced via sources 34 and 36 may be substantially "sulfur free," as discussed above, for example, a kraft green liquor treated to reduce or eliminate sulfur compounds, though substantially sulfur-free NaOH may also be used.

According to an aspect of the invention, the treatment liquid 26 or the recirculated treatment liquid 20, for example, the carbonate-containing solution, may also include a chelating agent, for example, at least one of diethylene-triamine-penta-acetic acid (DTPA), ethylene-diamine-tetra-acetic acid (EDTA), diethylene-triamine-penta-methylene-phosphonic acid (DTPMPA), or their derivatives or equivalents.

As discussed above, according to one aspect of the invention, the use of NaOH or the hydroxide ion ($OH^-$) is minimized or avoided entirely as the source of alkali in the N-stage, that is, in preference to the use of the carbonate anion ($CO_3^{2-}$) as the source of alkali in the N-stage. The desirability of the carbonate ion becomes apparent in view of the following pulping chemistry and test results.

In alkaline pulping chemistry, the alkali dose is normally presented as % $Na_2O$ on biomass (for example, on wood or on chips). The relevant reactions for carbonate and hydroxide are shown in equations [2] and [3]. Therefore, according to the chemical balances represented by equations [2] and [3], 1.0 g-mole of $Na_2O$ (that is, 2×23+16=62 grams) is equivalent to 106 grams of $Na_2CO_3$ or 80 grams of NaOH.

$$Na_2O+CO_2 \rightarrow Na_2CO_3 \quad [2]$$

$$Na_2O+H_2O \rightarrow 2NaOH \quad [3]$$

Accordingly, the use of carbonate allows for a lower $Na_2O$ application in the N stage because carbonate has a buffering capacity while hydroxide does not. The dissociation of $H_2CO_3$ (carbonic acid) to $CO_3^{2-}$ is shown in equations [4] and [5] along with the respective acid dissociation constants or "pKa values." According the understanding of the chemical reactions shown in equations [4], [5], and [6], when a low $OH^-$ dose is added to a hot biomass slurry, the $OH^-$ reacts with $H_3O^+$ (generated from dissociation of carboxylic acid groups) to form two moles of water (per equation [6]). Accordingly, the pH of the system quickly drops to about a pH of 7.0 (that is, substantially neutral) and then becomes acidic because hot water treatment of biomass generates carboxylic acids. In the case where the carbonate ion, $CO_3^{2-}$, is present, it is believed that the neutralization to $HCO_3^-$ (per equation [5] right to left) occurs relatively quickly. It is believed that the bicarbonate anion ($HCO_3^-$) buffers in the neutral pH range and very rarely does the pH fall below 7.0. When the pH of a dilute solution is equal to the pKa value, it is believed that the concentration of $H_2CO_3$ is approximately equal to the concentration of $HCO_3^-$. The buffering action occurs in the pH range of the pKa ±2 pH units and, at one pH unit above the pKa, the [$HCO_3^-$] concentration is approximately 10 times higher than [$H_2CO_3$] concentration. The reverse is also believed to be true when the pH is one unit lower than the pKa. When $H_3O^+$ is present in the 8.0 to 6.37 pH range, $HCO_3^-$ is converted to $H_2CO_3$ (equation [4] right to left) and the pH falls very slowly.

$$H_2CO_3+H_2O \leftrightarrow H_3O^++HCO_3^- \quad pKa=6.37 \quad [4]$$

$$HCO_3^-+H_2O \leftrightarrow H_3O^++CO_3^{2-} \quad pKa=10.25 \quad [5]$$

$$OH^-+H_3O^+ \rightarrow 2H_2O \quad [6]$$

Pulping Results

The above understanding of the pulping chemistry was investigated in a series of laboratory-scale tests. White birch was pulped (or delignified) by an Acid (A)-Neutralization (N) pretreatment followed by an SAQ pulping. In these tests, the parameters for both the A stages and the SAQ stages were held substantially constant and the alkali source and concentration for the N stage was varied. The results of these tests are summarized in Table 3. As shown in Table 3, it was found that the use of NaOH for the alkali in the N stage resulted in a pulping effluent with end pH of 5.8 or less (Trials 2 and 3) while the use of carbonate for the alkali in the N stage resulted in an end pH of 7.4 (Trial 1). According to aspects of the invention, even a mildly acidic treatment at 150° C. can significantly lower pulp yield and reduce end pH to less than 6, as obtained from N-stages using NaOH, and should be avoided. When the pretreated chips were treated in an SAQ stage, it is believed that some of the alkali in the cooking liquor was apparently consumed in re-neutralizing the chips having a pH less than 7 (Trials 2 and 3), and a higher kappa number was obtained for those pulps. In contrast, since carbonate pretreated of the chips results in a higher end pH, less or little alkali in the cooking liquor is consumed (Trial 1), and a lower kappa number was obtained. The inventor surmises that if a milder SAQ conditions, for example, a lower alkali charge, were used under the conditions of Trial 1 to increase the kappa number of the carbonate N-stage pulp from 13.4 to 15.8, it is believed that it would be almost certain that the pulp yield would increase to a value greater than that shown in Table 1, for example, to a yield greater than 51.0% on chips or higher.

TABLE 3

Effect of Alkali Used for N-Stage Treatment in AN-SAQ Cooking of Birch

| Trial | A-Stage end pH[1] | $Na_2O$ in N-Stage | pH[2] 0 min | pH 30 min | SAQ Kappa | Total[3] Yield, % |
|---|---|---|---|---|---|---|
| 1 | 3.5 | 3.0% ($Na_2CO_3$) | ~8.0 | 7.4 | 13.4 | 50.2 (<0.1) |
| 2 | 3.5 | 3.0% (NaOH) | 11.9 | 5.8 | 15.8 | 50.7 (0.1) |
| 3 | 3.5 | 1.5% (NaOH) | 6.6 | 5.4 | 18.2 | 51.7 (0.2) |

[1]A-Stage: 30 min to 120° C.; 30 min at 120° C.; 2% acetic acid on chips; 4:1 liquid to wood (L/W) ratio.
[2]N-Stage: 30 min to 150° C.; 30 min at 150° C.; 4:1 L/W ratio; pH values in Table 3 are for 0 min and 30 min at 150°.
[3]SAQ Stage: 14% $Na_2O$ (NaOH); 0.1% AQ; 0.25% $Na_2SO_3$; 60 min to 165° C.; 90 min at 165° C.; 4:1 L/W ratio. Total yield (% on chips) with percent rejects in parenthesis The data in Table 3 illustrate that, contrary to the prior art use of the hydroxide ion (OH) as the source of alkali for N-stage neutralization, use of the carbonate anion ($CO_3^{2-}$) as the source of alkali in the N-stage provides advantages. For example, as illustrated in the trials summarized in Table 3, the use of the carbonate ion provides a buffering effect upon the resulting pH of the A-N pretreated chips that could reduce the consumption of alkali during the subsequent pulping process. Thus, aspects of the present invention provide for a more selective pulping process, that is, a pulping process that provides greater delignification (as indicated by reduced kappa number) and comparable or increased pulp yield.

According to aspects of the invention, many different combinations of A-stage and N-stage effluent recycle or re-use may be practiced. In one aspect, at least some of the A-stage effluent may be recycled and little or no N-stage effluent may be recycled. In another aspect, at least 25%, preferably at least 50%, of the A-stage effluent may be recycled and little or no N-stage effluent may be recycled. In another aspect, 100% of the A stage effluent may be recycled and little or no N-stage effluent may be recycled. In another aspect, at least some of the A-stage effluent may be recycled and some N-stage effluent may be recycled, for example, at least 25% or at least 50% of the N stage effluent may be recycled. In one aspect, at least some of the A-stage effluent may be recycled and substantially 100% of the N-stage effluent may be recycled. In another aspect, 100% of the A stage effluent may be recycled and at least some of the N-stage effluent may be recycled, for example, at least 25%, or at least 50% of the N stage effluent may be recycled, though close to 100% of the N stage effluent may also be recycled. In one aspect, little or no A-stage effluent may be recycled and at least some N-stage effluent may be recycled, for example, at least 25%, preferably at least 50%, of the N-stage effluent may be recycled and little or no A-stage effluent recycle.

While several aspects of the present invention have been described and depicted herein, alternative aspects may be provided by those skilled in the art to accomplish the same objectives. Accordingly, it is intended by the appended claims to cover all such alternative aspects as fall within the true spirit and scope of the invention.

The invention claimed is:

1. A method of treating comminuted cellulosic material comprising:

treating the comminuted cellulosic material in a first stage with a first acidic solution to produce an acid treated material and a second acidic solution;

extracting the second acidic solution from the acid treated material and using at least some of the second acidic solution for at least some of the first acidic solution;

treating the acid treated material with a first carbonate-containing solution to produce a carbonate treated material and a second carbonate-containing solution;

extracting the second carbonate-containing solution from the carbonate treated material and using at least some of the second carbonate-containing solution for at least some of the first carbonate-containing solution; and treating the carbonate treated material with pulping chemical to produce a cellulose pulp.

2. The method as recited in claim 1, wherein the first carbonate-containing solution comprises substantially little or no hydroxide ions.

3. The method as recited in claim 1, wherein the first carbonate-containing solution comprises a hydroxide ion [$OH^-$] concentration less than the hydroxide ion concentration of a solution having an NaOH concentration of about 1 gram per liter of NaOH.

4. The method as recited in claim 1, wherein the method produces a cellulose pulp having greater yield than the pulp produced when practicing the method without treating the acid treated material with the first carbonate-containing solution.

5. The method as recited in claim 1, wherein the first carbonate-containing solution comprises little or no sulfur.

6. The method as recited in claim 1, wherein the carbonate-containing solution comprises a solution obtained from spent pulping chemical from the step of treating with pulping chemical.

7. The method as recited in claim 1, wherein the first carbonate-containing solution further includes a chelating agent.

8. The method as recited in claim 7, wherein the chelating agent comprises at least one of DTPA, EDTA, and DTPMPA.

9. The method as recited in claim 1, wherein the first carbonate-containing solution comprises a pH less than 12.3.

10. The method as recited in claim 9, wherein the first carbonate-containing solution comprises a pH less than 11.8.

11. The method as recited in claim 10, wherein the first carbonate-containing solution comprises a pH less than 10.

12. The method as recited in claim 1, wherein the first carbonate-containing solution comprises a pH greater than 7.

13. The method as recited in claim 1, wherein treating the carbonate treated material with a pulping chemical further comprises treating the carbonate treated material with one of a yield-enhancing chemical and a strength-enhancing chemical.

14. The method as recited in claim 13, wherein the yield-enhancing chemical comprises an anthraquinone.

15. The method as recited in claim 13, wherein the strength-enhancing chemical comprises a polysulfide.

16. The method as recited in claim 1, wherein the pulping chemical comprises one of NaOH and $Na_2S$.

17. The method as recited in claim 1, wherein the pulping chemical comprises substantially sulfur-free NaOH.

18. The method as recited in claim 1, wherein treating the comminuted cellulosic material in a first stage with the first acidic solution is practiced at a temperature less than 200 degrees C.

19. The method as recited in claim 1, wherein treating the comminuted cellulosic material in a first stage with the first acidic solution is practiced at a temperature less than 160 degrees C.

20. The method as recited in claim 1, wherein treating the comminuted cellulosic material in a first stage with the first acidic solution is practiced at a temperature less than 120 degrees C.

* * * * *